United States Patent [19]

Held

[11] Patent Number: 4,759,249

[45] Date of Patent: Jul. 26, 1988

[54] WEB SLITTING APPARATUS HAVING ADJUSTABLE LOWER CUTTING BLADES

[75] Inventor: Franz Held, Gross-Zimmern, Fed. Rep. of Germany

[73] Assignee: Maschinenfabrik Goebel GmbH, Darmstadt, Fed. Rep. of Germany

[21] Appl. No.: 909,912

[22] Filed: Sep. 22, 1986

[30] Foreign Application Priority Data

Sep. 21, 1985 [DE] Fed. Rep. of Germany ..... 3533739

[51] Int. Cl.[4] ..... B26D 7/06

[52] U.S. Cl. ..... 83/425.4; 83/499; 83/504; 83/508.3

[58] Field of Search ..... 83/169, 477.1, 425.4, 83/676, 504, 508.2, 508.3, 498; 384/115, 118

[56] References Cited

U.S. PATENT DOCUMENTS 3,583,270 6/1971 Webb ..... 83/433
3,753,517 8/1973 Takenaka et al. ..... 384/115

FOREIGN PATENT DOCUMENTS 7702226 1/1977 France .
81/100199 12/1981 PCT Int'l Appl. .

*Primary Examiner*—Frank T. Yost
*Assistant Examiner*—Scott A. Smith
*Attorney, Agent, or Firm*—Watson, Cole, Grindle & Watson

[57] ABSTRACT

The lower, circular cutters of an apparatus for longitudinally slitting a continuous web are axially adjustable by the provision of a thin film of compressed air between the cutters and the support shaft.

2 Claims, 2 Drawing Sheets

WEB SLITTING APPARATUS HAVING ADJUSTABLE LOWER CUTTING BLADES

BACKGROUND OF THE INVENTION

This invention relates to an apparatus for longitudinally slitting a continuous web, and more particularly to such an apparatus in which a lower, circular cutter or cutters mounted on a shaft journaled on a machine frame for rotation are capable of being axially shifted to accommodate various web widths to be slit.

Apparatus for longitudinally slitting a traveling web of paper, foil, cloth, plastic, metal or like material, may employ the known straight cut or looped cut approach. In the looped cut technique, the web to be slit into individual strips travels tangentially between at least one top and at least one bottom circular blade so that at least two strips may be slit from a single web. Usually, several upper and lower balde pairs are employed for slitting a relatively wide web into a plurality of relatively narrow strips.

Webs of various widths are often desired by the end processor of the web to be slit. Thus, a relatively wide web must be slit during one production process, for example into relatively wide webs, and during another production process into relatively narrow webs. These slitted webs are usually rewound into rolls for easy handling and processing by the end processor.

Since the needs of the end processor may change, a relatively wide web may need to be subdivided into more narrow webs thereby requiring the slitting apparatus to be reset. This process is usually referred to as "positioning."

During the straight cut approach it is relatively simple to position the bottom and top cutting blades, since the web does not bear against one of the blade pairs so as to impede positioning. However, during the looped cut approach, it is more difficult to shift the lower blade or blades embraced by the web which presses against the lower blade or blades due to web tension which normally predominates in the web for processing purposes. The movability of the lower blade or blades along the support shaft is therefore limited, such that special provisions must be made to facilitate easier axial adjustment of the lower blade or blades.

U.S. Pat. No. 3,583,270 discloses a slitter apparatus for traveling webs in which the lower cutters are driven by their own motors and are capable of being shifted over the width of the web to be cut to the desired position by means of an air cushion introduced to provide air bearings between the motor platform and transversely extending rails.

In published PCT application WO 83/02083 a cutting device is disclosed in which the support hub of the cutting blade is enlarged by means of pressurized hydraulic fluid, annular chambers or grooves at the inner circumferential surface of the hub being provided for this purpose.

French Pat. No. 2,340,170 discloses a similar cutting device in which the support hub of a circular cutter is enlarged as pressurized hydraulic fluid is directed into an open groove at the inner circumferential surface of the hub.

SUMMARY OF THE INVENTION

It is therefore an object of the present invention to provide an axially adjustable lower cutting blade or blades of a longitudinal web slitter, especially when employing the looped cut approach, in it simple yet highly effective and economical manner requiring a limited number of parts.

This objective is carried out according to the invention in that the rotating shaft on which lower, circular cutter means is mounted has at least one radial bore and a longitudinal passage. The bore communicates with the passage and has an outlet opening into a smooth inner peripheral surface of the cutter means. The size of the outlet is less than the axial extent of the cutter means such that the cutter means may be axially shifted a given distance on the shaft without uncovering the outlet. Air under pressure is supplied to the radial bore through the passage to facilitate axial adjustment to the cutter means on the shaft. A device is provided for setting the shaft in a predetermined rotative position prior to such axial adjustment, such that the outlet of the radial bore lies in an upward circumferential half of the shaft when in such rotative position.

Several lower, circular cutter means, each having at least one cutting blade, may be axially spaced on the shaft, and radial bores in the shaft each communicate with the passage and respectively outlet into one of the cutting means. The size of the outlets are respectively less than the axial extent of the smooth inner surfaces of the respective cutting means, and all of the outlets lie in the upper circumferential half of the shaft when in the rotative position at which axial adjustment is carried out.

Other objects, advantages and novel features of the invention will become more apparent from the following detailed description of the invention when taken in conjunction with the accompanying drawings.

DETAILED DESCRIPTION OF THE INVENTION

Figure 1:
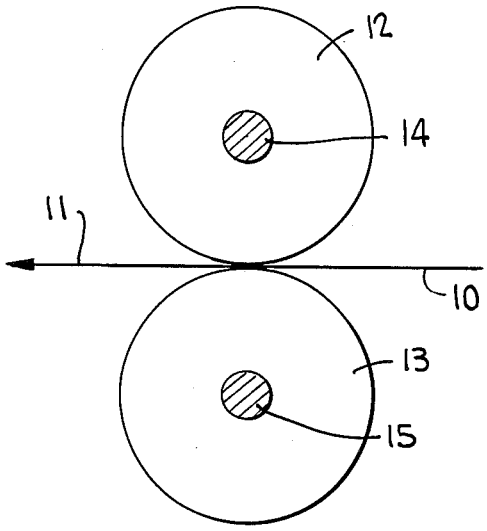
FIG. 1 is a schematic end view of upper and lower coacting cutters of an apparatus for longitudinally slitting a web employing a straight cut.

Turning now to the drawings wherein like reference characters refer to like and corresponding parts throughout the several views, a continuous web 10 to be slit into several strips 11 travels between upper and lower cutting blades 12 and 13 respectively mounted on shafts 14 and 15. The opposite ends of the shafts are journalled on a machine frame (not shown) for rotation in any normal manner known in this art. For changing the width of the strips to be slit, top cutter or cutters 12 can be shifted along its shaft 14, and the bottom cutter or cutters 13 can be correspondingly shifted along its support shaft 15, as required. This displacement can be relatively slight, especially if the lower cutter has several slightly spaced cutting blades. The lower blades can be in the form of so-called cutter boxes (cutting bushes), each cutter box having a plurality of cutting blades. The same upper cutter blade can coact with each of these cutting edges so that, during format resetting, the top cutting blades must be shifted a relatively long distance, although the lower cutting blade needs to be shifted by a much shorter distance to facilitate cooperation of the upper cutting blade with another lower cutting edge.

Figure 2:
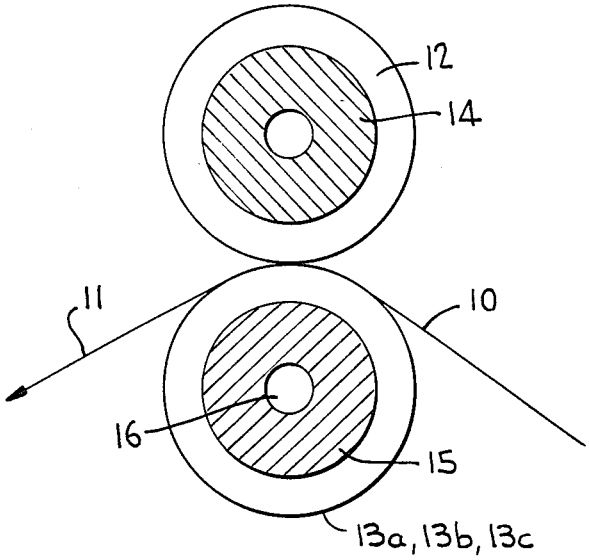
FIG. 2 is a view similar to FIG. 1 except that a looped cut approach is employed.

In the loop cut approach of FIG. 2, the web partially embraces the lower cutting blade or blades 13 such that the web to be slit may be more steadily maintained during the cutting process compared to that of the straight cut approach of FIG. 1. However, it becomes more difficult to axially adjust the lower cutters in the FIG. 2 arrangement to accommodate different web widths while the web lies at the nip between the upper and lower cutters. Because the web is under tension, and partially embraces the lower cutter or cutters during the loop cut approach, the forces applied against the lower cutter or cutters impede the displacement of the lower cutting blades along support shaft 15. The present invention avoids this difficulty in a simple yet highly effective manner.

Figure 3:
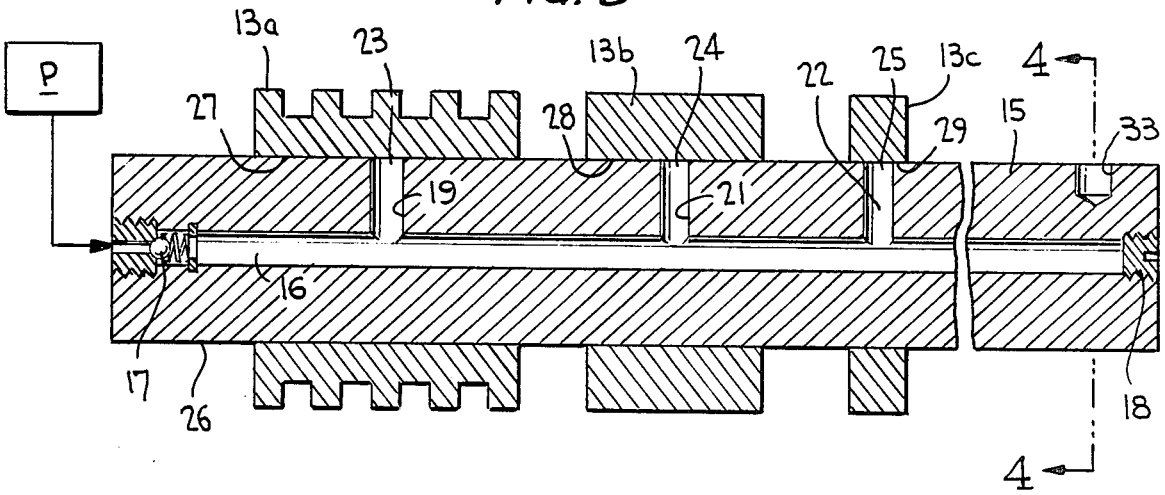
FIG. 3 is a longitudinal sectional view taken through the lower support shaft and cutters of the FIG. 2 apparatus.

As shown in FIG. 3, several lower cutters 13*a*, 13*b*, 13*c* may be mounted on support shaft 15, and may be axially spaced apart in any normal manner. The shaft has at least one longitudinal passage 16 with a one-way ball check valve 17 at one end and a screw plug 18 closing the opposite end. The shaft likewise has radial bores 19, 21, 22 each communicating with passage 16 and each having an outlet 23, 24, 25 extending through outer periphery 26 of the shaft. In FIG. 3, the lower cutters 13 are shown mounted directly on shaft 15, although the cutters may be mounted on hubs in some normal manner which are in turn mounted on the support shaft. In any event, the inner peripheral surface 27, 28, 29 of the cutters, or of their respective hubs (not shown), are smooth and of a predetermined axial extent which may differ for the lower cutters as shown. Radial bores 19, 21, 22 are respectively associated with cutters 13*a*, 13*b*, 13*c* and open into their respective inner peripheral surfaces 27, 28, 29. The central portions of the cutters overlie their respective bores, and the bores sizes are less than the axial extent of the respective cutters such that the cutters may be axially shifted on shaft 15 at least a slight distance without uncovering the outlet of its respective radial bore. And, the lower cutter blade is capable of being shifted axially on its shaft only to that extent allowed as its inner peripheral surface covers its respective bore outlet.

Air under pressure is introduced from a pressure source P through passage 16 and through the radial bores to facilitate axial displacement of the lower cutters on support shaft 15 as the compressed air occupies the slight machined gap provided as a normal tolerance between the cutter blades or their hubs and the outer periphery of the support shaft. Internal grooves or channels are therefore not required to be provided at inner peripheral surfaces 27, 28, 29 and/or at outer peripheral surface 26.

Figure 4:
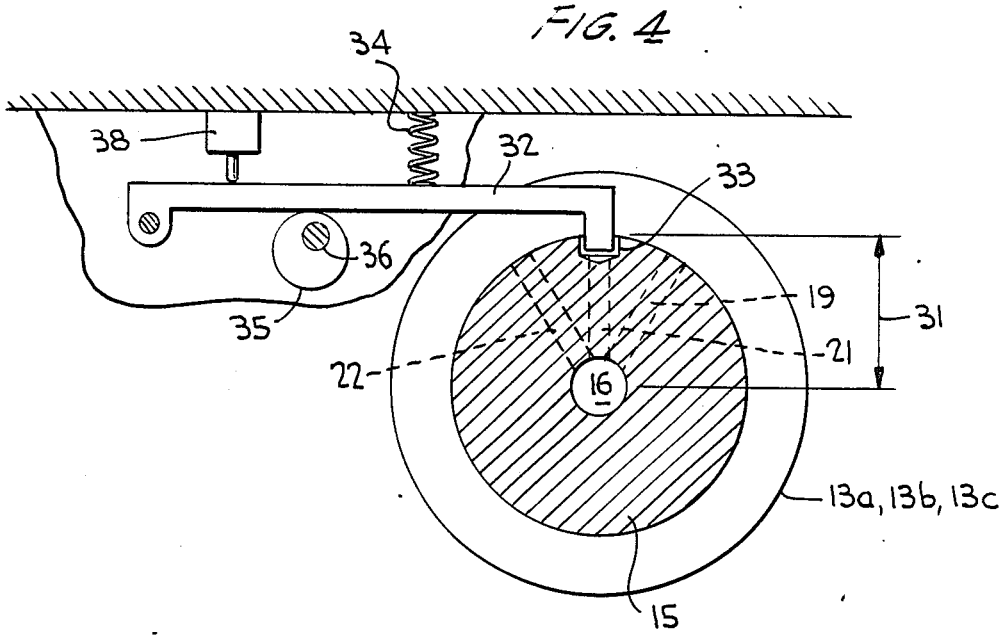
FIG. 4 is a cross-sectional view taken substantially along the line 4—4 of FIG. 3 and further showing the shaft setting device of the invention.
Figure 5:
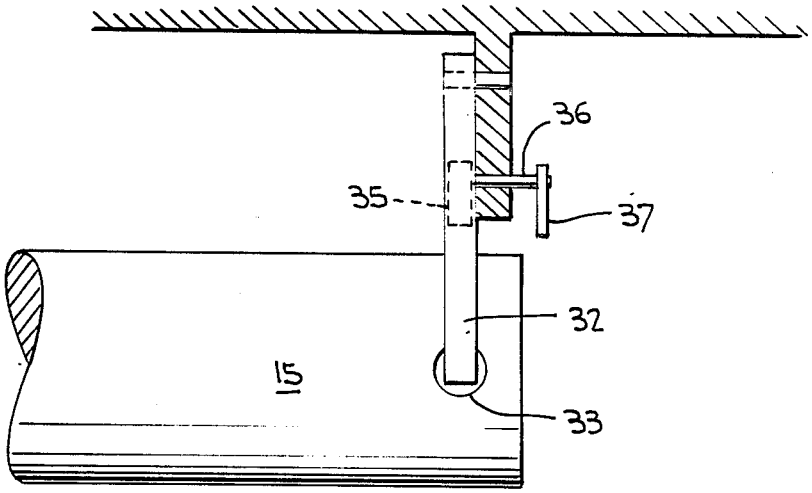
FIG. 5 is a top plan view of the positioning device and shaft of FIG. 4.

Since no such grooves or channels are provided, it is of advantage for outlets 23, 24, 25 of the radial bores to be located in upper circumferential half 31 of shaft 15 in a rotative position of the shaft when stopped in readiness for axial displacement of the cutters. As shown in FIG. 4, a positioning apparatus is provided which may comprise a latch 32 engaged with a recess or groove 33 provided in outer periphery 26 of shaft 15. The latch arm can be spring biased into this engagement by the provision of a spring 34 extending between the latch arm and some convenient support surface of the machine frame. A cam plate 35 rotatably mounted on the machine frame may be provided for disengaging the latch arm upon cam rotation about its shaft 36 by the provision of a hand lever 37 (FIG. 5). A switch 38 may be provided for preventing the machine from continuing to run when the latch arm is engaged with recess 33.

Recess 33 is preferably located at one end of the shaft so that substantially the entirety of the shaft remains available for positioning the lower cutting blades thereon.

In lieu of the mechanical positioning device aforedescribed, support shaft 15 may be provided with a known angle of rotation transducer for stopping the shaft electrically or electronically together with an on-and-off switchable brake acting on the shaft, such that outlets 23, 24, 25 of radial bores 19, 21, 22 extend primarily upwardly when the shaft is stopped prior to cutter blade adjustment.

And, since compressed air is employed as a pressure medium, the lower cutters may be raised upwardly relative to shaft 15 by an insignificant amount with a cushion of pressure being maintained on which the lower blade or blades float and can accordingly be easily adjusted axially.

In accordance with the invention, the heavy cutter boxes may likewise be easily shifted which would otherwise be incapable of manual displacement by the operator due to their own weight.

The cutter boxes or cutter blades can be displaced axially along their support shaft a distance determined by the axial extent of the inner peripheral surfaces thereof, i.e. so long as the respective radial bores remain covered during displacement. The cutting blade or cutter box is simply raised a small amount relative to its shaft by the pressure medium passing through the radial bore or bores, and is capable of gliding on a thin cushion of pressure medium. Thus, the inner peripheral surfaces 27, 28, 29 and/or the outer peripheral surface 26 need not have special chambers or channels to accommodate the pressure medium between these inner and outer peripheral surfaces according to the invention. The thin cushion of pressure medium simply fills the tolerance gap normally machined between such inner and outer peripheral surfaces.

It is also possible to permit the respective upper cutting blade in a specific cutting process to coact with one and during another cutting process, with another edge of the respective lower blade for the respective cutter box. This increases either the idling time of the bottom cutter box or facilitates the production of strips, having different widths, of materials, to the slit from a web, while simultaneously displacing the respective bottom cutter box with respect to the top cutter blade. Thus, the present invention allows for resetting from a cutting and eventually winding format to another.

Moreover, the cutting dust which normally collects between outer peripheral surface 26 and inner peripheral surfaces 27, 28, 29, is simply discharged by the pressure medium, especially when using compressed air.

The lower cutters, or their mountings, can be of different axial extent without departing from the invention. Also, a separate supply of compressed air can be fed to each radial bore so that selective lower cutters can be displaced on the shaft, while other lower cutters maintain their position.

From the foregoing, it can be seen that air under pressure can be caused to slightly space the inner peripheral surfaces of the lower cutters or their mountings away from the outer peripheral surface of their support shaft to permit axial displacement to adjust the web slitter to accommodate various web widths.

Obviously, many modifications and variations of the present invention are made possible in the light of the above teachings. It is therefore to be understood that within the scope of the appended claims the invention may be practiced otherwise than as specifically described.

What is claimed is:

1. In an apparatus for longitudinally slitting a continuous web, at least one lower, circular cutter means mounted on a shaft adapted to be journalled on a machine frame for rotation, said cutter means having a smooth and uninterrupted inner peripheral surface of a predetermined axial extent, said shaft having a smooth and uninterrupted outer peripheral surface, at least one radial bore and a longitudinal passage, said bore communicating with said passage and having an outlet opening into said inner peripheral surface, the size of said outlet being less than said axial extent of said cutter means such that said cutter means may be axially shifted on said shaft without uncovering said outlet, means for supplying air under pressure to said bore through said passage to facilitate axial adjustment latch means for engaging the shaft for setting the shaft in a position in which said outlet of all of said radial bores lie only in an upper circumferential half of said shaft prior to axial adjustment of said cutter means.

2. In the apparatus according to claim 1, wherein a plurality of axially spaced, lower, circular cutter means are mounted on said shaft, each of said cutter means including at least one cutting blade, and each of said cutter means having smooth inner peripheral surfaces each of a predetermined axial extent, said shaft having radial bores communicating with said passage and terminating in outlets respectively opening into said inner peripheral surfaces, the size of said outlets being respectively less that the axial extent of said surfaces, and said outlets lying in said upper circumferential half when in said rotative position.

* * * * *